United States Patent [19]

Agiotis

[11] 4,168,713

[45] Sep. 25, 1979

[54] METHODS AND APPARATUS FOR SECURING HAIRPIECES

[76] Inventor: Demetre Agiotis, 2007 Yonge St., Toronto, Ontario, Canada, M4S 1Z8

[21] Appl. No.: 879,198

[22] Filed: Feb. 21, 1978

[51] Int. Cl.[2] ..... A41G 3/00

[52] U.S. Cl. ..... 132/53

[58] Field of Search ..... 132/53, 54, 5; 225/44

[56] References Cited

U.S. PATENT DOCUMENTS

| | | | |
|---|---|---|---|
| 573,563 | 12/1896 | Yeakel | 225/44 X |
| 3,699,978 | 10/1972 | Holly | 132/53 |
| 3,889,694 | 6/1975 | Greer | 132/53 |

FOREIGN PATENT DOCUMENTS

| | | | |
|---|---|---|---|
| 2103182 | 8/1972 | Fed. Rep. of Germany | 132/53 |

*Primary Examiner*—G. E. McNeill

*Attorney, Agent, or Firm*—Sim & McBurney

[57] ABSTRACT

A hairpiece is secured to a person's head using crimpable devices that are secured to the person's natural hair around the periphery of the area to be covered by the hairpiece by being crimped onto the natural hair. The hairpiece then is detachably connected to the devices, springs preferably being employed for this purpose.

23 Claims, 7 Drawing Figures

METHODS AND APPARATUS FOR SECURING HAIRPIECES

BACKGROUND OF THE INVENTION

This invention relates to methods and apparatus for securing toupees, wigs and other hairpieces to the head of a person.

One technique for securing a hairpiece to the head of a person involves the use of double-sided adhesive tape. While this technique has been used quite extensively, it suffers from a number of disadvantages. More specifically, this technique only can be used where a bald spot exists to which the tape can be adhered. Thus, this technique is not suitable where what is required is to cover a "thin" spot rather than a bald spot. In addition, the use of hairpiece tape results in the application of adhesive to the base of the hairpiece. This tends to mat and clog the hairpiece and may result in hairs being pulled out of the hairpiece during removal of the hairpiece from the wearer's head. Likewise hair may be pulled out of the wearer's scalp during removal of the hairpiece. Furthermore, the tape should be replaced each time the hairpiece is removed. This is time consuming. If this is not done, however, the tape gradually will lose its adhesive properties, making the hairpiece less secure on the wearer's head. The other problem with the use of hairpiece tape simply is that many people do not feel that a hairpiece secured by tape is fastened securely enough for daily activities and sleep and refuse to use hairpiece tape for that reason.

Another common technique for securing a hairpiece to the head of a person is known as hairweaving. In this technique a light cord foundation is secured to the head of a person by weaving it and the person's own hair together The hairpiece then is sewn to the resulting braid. Hairweaving requires the services of a professional and is time consuming and expensive. In addition, since the hairpiece cannot be removed for washing, except by a professional, the hairpiece frequently is washed in situ. Hairpieces cannot be properly cleaned in this way, so dirt, scalp oil and dandruff tend to accumulate, particularly in the area of the braid. Finally, many people object to the tight feeling of the braid about their head.

Yet a further technique for securing a hairpiece to the head of a person is known as suture implantation. In this technique hooks or other devices are surgically implanted in the scalp, and the hairpiece then is sewn or otherwise secured to the hooks. Bleeding and the risk of infection is a continuous problem with this technique, and any tug on the hairpiece is painful.

In accordance with this invention there are provided methods and apparatus for securing a hairpiece to the head of a person that overcome a substantial number of the foregoing disadvantages. Such methods and apparatus can be used to cover "thin" spots as well as bald spots. Adhesives removal of hair from the hairpiece or wearer's head during its removal from the scalp. While the technique of this invention requires the services of a professional for the initial fitting of the hairpiece, the hairpiece can be removed for washing and put back into place by someone other than a professional. No surgical implantation is employed, so the disadvantages of that technique (bleeding and infection of the areas of implantation) are avoided.

BRIEF DESCRIPTION OF THE INVENTION

In accordance with one aspect of this invention there is provided apparatus for securing a hairpiece to the head of a person having some natural hair, said apparatus comprising a plurality of members adapted to be secured to said natural hair at spaced apart locations around the periphery of the area to be covered by said hairpiece by crimping of portions of said members onto said natural hair, each said portion defining a channel for receiving said natural hair and being formed of a crimpable material which when crimped by subjecting said portion to compressive forces to close said channel permanently deforms and fastens itself to natural hair in said channel, whereby said members are secured to said natural hair as a result of permanent deformation of said portions resulting from crimping thereof, and means for detachably connecting a hairpiece to said members.

In accordance with another aspect of this invention there is provided a method for securing a hairpiece to the head of a person having some natural hair, said method comprising providing a hairpiece having detachably connected thereto a plurality of members adapted to be secured to said natural hair at spaced apart locations around the periphery of the area to be covered by said hairpiece by crimping of portions of said members onto said natural hair, each said portion defining a channel for receiving said natural hair and being formed of a crimpable material which when crimped by subjecting said portion to compressive forces to close said channel permanently deforms and fastens itself to natural hair in said channel, placing said hairpiece over the area to be covered thereby with said members being located between said hairpiece and said head, placing said natural hair in said channels, and securing said members to said natural hair at spaced apart locations around the periphery of the area to be covered by said hairpiece by crimping said portions onto said natural hair.

In accordance with another aspect of this invention there is provided a method for securing a hairpiece to the head of a person having some natural hair, said method comprising providing a plurality of members adapted to be secured to said natural hair at spaced apart locations around the periphery of the area to be covered by said hairpiece by crimping of portions of said members onto said natural hair, each said portion defining a channel for receiving said natural hair and being formed of a crimpable material which when crimped by subjecting said portion to compressive forces to close said channel permanently deforms and fastens itself to natural hair in said channel, placing said natural hair in said channels, securing said members to said natural hair at spaced apart locations around the periphery of the area to be covered by said hairpiece by crimping said portions onto said natural hair, and then detachably connecting said hairpiece to said members.

BRIEF DESCRIPTION OF THE DRAWINGS

This invention will become more apparent from the following detailed description, taken in conjunction with the appended drawings, in which.

DETAILED DESCRIPTION OF THE INVENTION INCLUDING THE PREFERRED EMBODIMENTS

Figure 1:
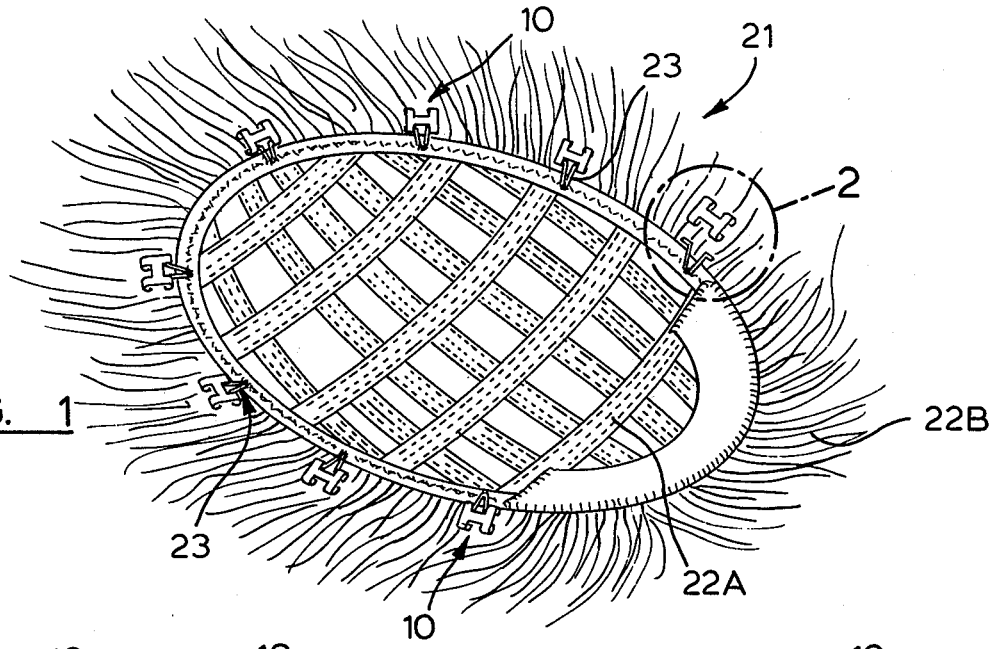
FIG. 1 is a perspective view of a hairpiece provided with crimpable devices embodying the instant invention.

The essence of the instant invention is the use of crimpable devices or clips that can be securely fastened to the natural hair on the head of the person to which the hairpiece is to be applied. A preferred embodiment of such a clip is shown at 10 in FIG. 2. This clip is made of thin sheet metal, copper being preferred, and is formed from a generally H-shaped blank 11 that is shown in FIG. 3. Two of the legs of the H-shaped blank on the same side of the crosspiece of the H are formed into eyes 12 and 13 having openings 14 and 15 respectively, while the other two legs of the blank are formed into generally U-shaped members 16 and 17 that define channels 18 and 19 respectively. Eyes 12 and 13 and U-shaped members 16 and 17 are spaced apart from each other by channels 20. The clip is generally rectangular in configuration with eyes 12 and 13 at and adjacent two adjacent corners and members 16 and 17 at and adjacent the other two corners. Eye 12 and member 16 are adjacent one side of the clip, while eye 13 and member 17 are adjacent the opposite side of the clip.

Figure 5:
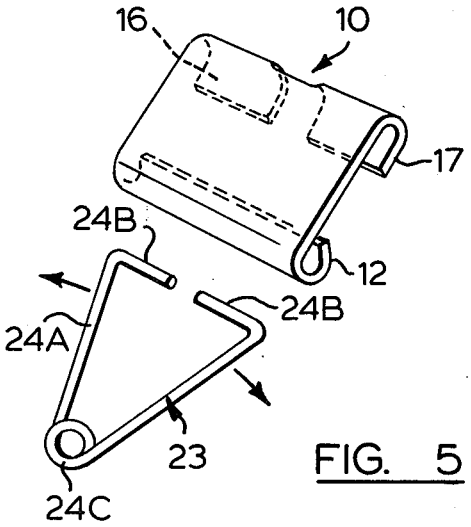

Another clip 10 which may be used in the practice of this invention is shown in FIG. 5. It differs from clip 10 shown in FIG. 2 in that it has a single eye 12 extending between two adjacent corners of the clip rather than separate eyes 12 and 13 are shown in FIG. 2.

Figure 4:
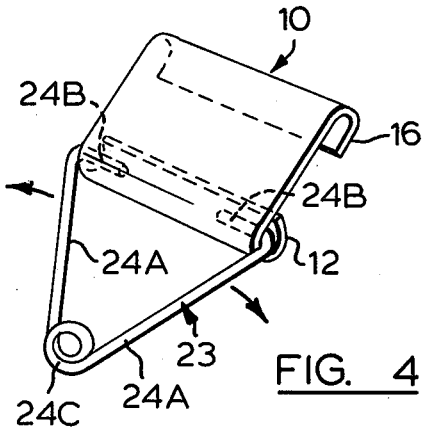
FIGS. 4 and 5 are perspective views of other types of crimpable devices and springs that can be used in the practice of the instant invention.

Another clip 10 which may be used in the practice of this invention is shown in FIG. 4. It differs from clip 10 shown in FIG. 2 in that it has a single eye 12 and a single U-shaped member 16 rather than separate eyes 12 and 13 and separate U-shaped members 16 and 17 as shown in FIG. 2.

Figure 2:
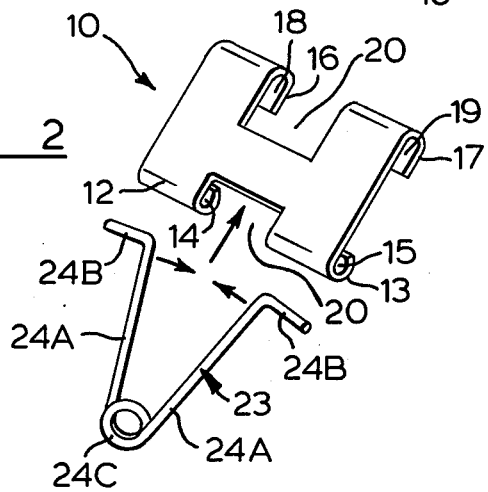
FIG. 2 is a perspective view of a crimpable device embodying the instant invention and of a spring for securing the same to a hairpiece.
Figure 3:
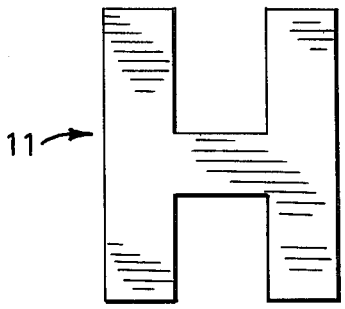
FIG. 3 shows a blank from which the crimpable device of FIG. 2 can be fabricated.

The clip shown in FIG. 2 constitutes the preferred embodiment of a clip that may be used in practising the instant invention. The reason for this will become more apparent hereinafter. It is to be understood, however, that crimpable clips having configurations other than those shown in FIGS. 2, 4 and 5 may be used in practising the instant invention.

Referring now to FIG. 1, there is shown a hairpiece 21 composed of a hairpiece base 22A to which is sewn or otherwise fastened hair 22B. Fastened to hairpiece base 22A are devices 23 that are adapted to detachably connect to clips 10. In the embodiment illustrated, which is the preferred embodiment, devices 23 are springs, and springs 23 are sewn to hairpiece base 22A. It is to be understood that other means than sewing can be employed to secure devices 23 to the hairpiece base. It also is to be understood that devices other than springs can be used to detachably connect the hairpiece to clips 10.

Springs 23 are made from conventional spring material, preferably of corrosion resistant material. Two types of springs may be used, these being shown in FIGS. 2 and 4 respectively. Spring 23 of FIG. 2 has legs 24A with ends 24B that insert into openings 14 and 15 in eyes 12 and 13 from inside the eyes, as shown in FIG. 2. The part 24C of spring 23 that interconnects legs 24A exerts a spring force tending to spring the legs apart when the legs are forced together, the spring force of spring 23 of FIG. 2 thus being directed outwardly when the spring is compressed, as shown by the arrows, to insert ends 24B into eyes 12 and 13. Spring 23 of FIG. 5, on the other hand, has legs 24A with ends 24B that insert into openings 14 and 15 in eyes 12 and 13 from outside the eyes, as shown in FIG. 5. The part 24C of spring 23 of FIG. 5 that interconnects legs 24A exerts a spring force tending to spring the legs together when the legs are forced apart, the spring force of spring 23 of FIG. 5 thus being directed inwardly, when the legs thereof are forced apart, as shown by the arrows, to insert ends 24B into eyes 12 and 13. It will be apparent that clip 10 of FIG. 2 can be used with either type of spring, whereas clips 10 of FIGS. 4 and 5 can be used with only a spring of the type shown in FIGS. 4 and 5, this being one reason why clip 10 of FIG. 2 constitutes a preferred embodiment.

Figure 6:
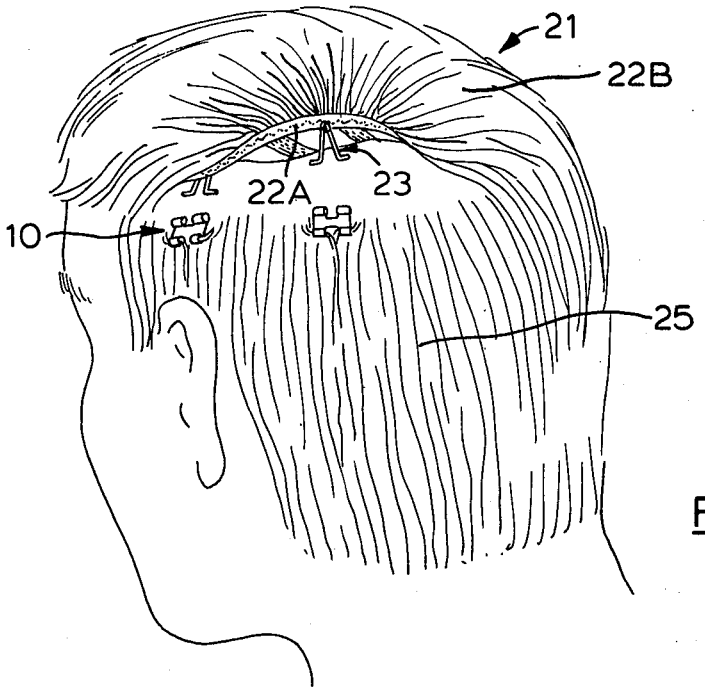
FIG. 6 is a view illustrating how a hairpiece can be affixed to a person's head by a technique embodying the instant invention.
Figure 7:
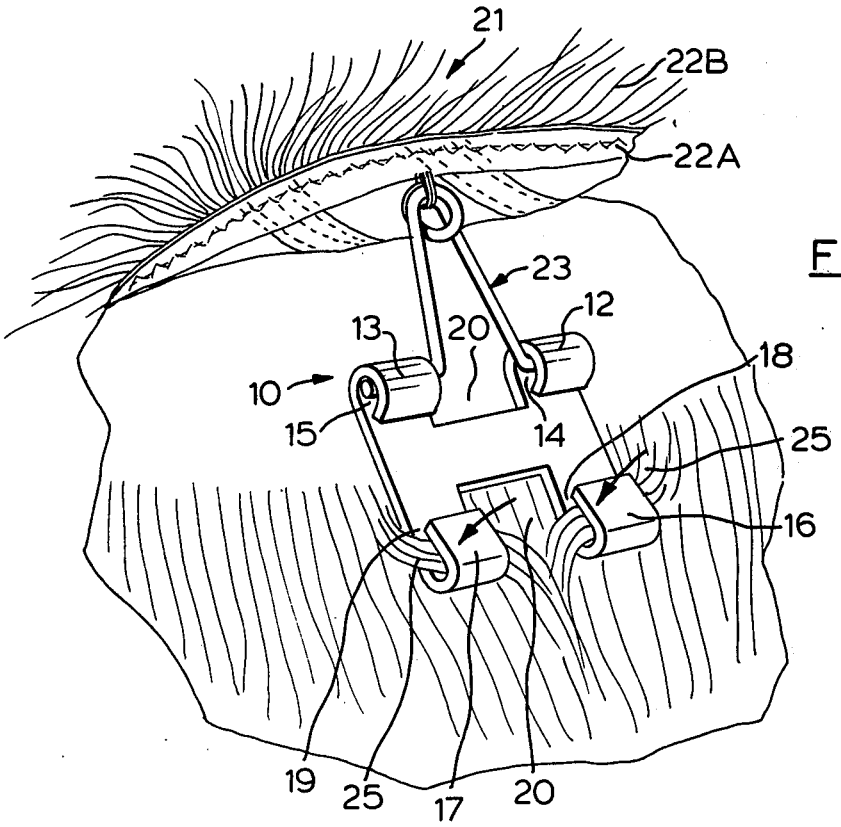
FIG. 7 is a close-up view showing how a hairpiece is connected to a person's natural hair in accordance with the instant invention.

In practising the instant invention clips 10 are secured to the natural hair on the head of the person to which the hairpiece is to be affixed. This is best shown in FIGS. 6 and 7. The natural hair 25 is lead into channels 18 and 19 and then through channel 20, as best shown in FIG. 7. After this has been done, the sections of clip 10 that define channels 18 and 19, in other words, the generally U-shaped members 16 and 17 are crimped using needle nosed pliers or a similar tool, causing clips 10 to become securely fastened to natural hair 25.

Clips 10 are secured at spaced intervals around the hairline of the person to whom the hairpiece is to be secured, the clips thus being located around the periphery of the area to be covered by the hairpiece. Depending upon the weight of the hairpiece, the clips can be placed about one to three inches apart. A certain minimum number of clips properly spaced will be required to hold any given hairpiece tightly in proper position, but any person skilled in the hairpiece applying art will have no difficulty in determining the number of placement of clips to be used.

Clips 10 of the type shown in FIG. 2 are preferred because they can be secured to the natural hair from both sides of the clip, thereby "balancing" the clip on the natural hair and distributing any pull on the clip to the natural hair on both sides of it. In the case of the clip shown in FIG. 4, hair is lead into channel 12 from only one side, making this clip less preferred from a "balancing" and force distribution point of view.

In the preferred method of the invention clips 10 are secured to springs 23, hairpiece 21 is positioned properly on the head of the person to whom it is to be secured and clips 10 then are crimped to the natural hair. This is the easiest way to get a tight fit.

Alternatively clips 10 may be secured to natural hair 25 and the hairpiece then may be fixed to the clips by springs 23. If this technique is employed, however, the placement of clips 10 to ensure registry with springs 23 and to ensure a tight fit is much more difficult.

While the initial installation of clips 10 requires the services of a professional, after hairpiece 21 has been secured in place it can be removed and put back into place by a non-professional. All that is required is a simple tool like a pair of tweezers or a crochet hook to release and to re-apply springs 23.

Of course, the natural hair to which clips 10 are secured will grow causing hairpiece 21 to become loose. Initially this can be compensated for by twisting clips 10 one or more times so as to bring them closer to the scalp and their original position. In due course, however, new clips 10 will have to be provided. This will be done by a professional and involves cutting the hair securing the old clips close to the clips, throwing the old clips away and affixing new ones in position. Desirably the new clips should be fastened to strands of natural hair other than those to which the previous clips were secured to relax the tension on the latter strands.

Reference is made herein to the crimping of clips 10 and to the use of crimpable clips. What is meant by this terminology, here and in the claims, is a clip made of such a material that, when two parts of the clip are compressed together, with another member being located between such parts, these parts become affixed to such member and do not spring back to release the member when the compressive force is removed.

Clips 10, in addition to being crimpable, preferably are fabricated from a corrosion resistant material, particularly a material that will not corrode appreciably when subjected to water. Copper is a particularly suitable material but is not the only metal from which clips 10 can be made.

An important aspect of the preferred embodiment of the invention is the quick connect and disconnect that can be achieved by using springs 23. In a less preferred embodiment clips 10 could be sewn to the hairpiece, but this is much less desirable, since every time the hairpiece was removed, e.g., for washing, a professional would be required to re-apply it.

What is claimed is:

1. Apparatus for securing a hairpiece to the head of a person having some natural hair, said apparatus comprising a plurality of members adapted to be secured to said natural hair at spaced apart locations around the periphery of the area to be covered by said hairpiece by crimping of portions of said members onto said natural hair, each said portion defining a channel for receiving said natural hair and being formed of a crimpable material which when crimped by subjecting said portion to compressive forces to close said channel permanently deforms and fastens itself to natural hair in said channel, whereby said members are secured to said natural hair as a result of permanent deformation of said portions resulting from crimping thereof, and means for detachably connecting a hairpiece to said members.

2. Apparatus according to claim 1 wherein said means for detachably connecting said hairpiece to said members comprise spring means.

3. Apparatus according to claim 1 wherein said spring means are sewn to said hairpiece.

4. Apparatus according to claim 2 wherein at least one of said spring means has two spaced apart legs and a part interconnecting said legs that exerts a spring force tending to spring said legs apart when said legs are forced together.

5. Apparatus according to claim 4 wherein at least one of said members has eyes engageable by said legs to detachably connect said hairpiece to said member.

6. Apparatus according to claim 5 wherein each said portion of said one member is generally U-shaped in configuration.

7. Apparatus according to claim 6 wherein said one member has two of said portions, one of said portions defining a first one of said channels and being located adjacent one side of said member, the second of said portions defining a second one of said channels and being located adjacent the opposite side of said member, said portions being separated by a third channel which receives said natural hair located in both said first and second channels.

8. Apparatus according to claim 7 wherein there are first and second ones of said eyes, said eyes being spaced apart from each other and from said portions with said first eye being located adjacent said one side of said one member and said second eye being located adjacent said opposite side of said one member.

9. Apparatus according to claim 8 wherein said one member is generally rectangular in configuration having four corners, said eyes being located at and adjacent two adjacent corners, said first and second portions being located at and adjacent the other two adjacent corners.

10. Apparatus according to claim 2 wherein at least one of said spring means has two spaced apart legs and a part interconnecting said legs that exerts a spring force tending to spring said legs together when said legs are forced apart.

11. Apparatus according to claim 10 wherein at least one of said members has at least one eye engageable by said legs to detachably connect said hairpiece to said member.

12. Apparatus according to claim 11 wherein each said portion of said one member is generally U-shaped in configuration.

13. Apparatus according to claim 12 wherein said one member has two of said portions, one of said portions defining a first one of said channels and being located adjacent one side of said member, the second of said portions defining a second one of said channels and being located adjacent the opposite side of said member, said portions being separated by a third channel which receives said natural hair located in both said first and second channels.

14. Apparatus according to claim 13 wherein there are first and second ones of said eyes, said eyes being spaced apart from each other and from said portions with said first eye being located adjacent said one side of said one member and said second eye being located adjacent said opposite side of said one member.

15. Apparatus according to claim 14 wherein said one member is generally rectangular in configuration having four corners, said eyes being located at and adjacent two adjacent corners, said first and second portions and said third and fourth portions being located at and adjacent the other two adjacent corners.

16. Apparatus according to claim 13 wherein said one member is generally rectangular in configuration having four corners, said eye being located between two adjacent corners, said first and second portions being located at and adjacent the other two adjacent corners.

17. Apparatus according to claim 1 wherein said members each have at least one eye to which said means for detachably connecting said hairpiece to said members may be detachably connected.

18. Apparatus according to claim 1 wherein each said portion of each said member is generally U-shaped in configuration.

19. Apparatus according to claim 1 wherein each said member has two of said portions, one of said portions defining a first one of said channels and being located adjacent one side of said member, the second of said portions defining a second one of said channels and being located adjacent the opposite side of said member, said portions being separated by a third channel which receives said natural hair located in both said first and second channels.

20. Apparatus according to claim 19 wherein said members each have at least two eyes to which said means for detachably connecting said hairpiece to said member may be detachably connected, said eyes of each said member being spaced apart from each other and from said portions with said first eye being located adjacent said one side of said member and said second eye being located adjacent said opposite side of said member.

21. Apparatus according to claim 20 wherein each of said members is generally rectangular in configuration having four corners, said eyes being located at and adjacent two adjacent corners, said first and second portions being located at and adjacent the other two adjacent corners.

22. A method for securing a hairpiece to the head of a person having some natural hair, said method comprising providing a hairpiece having detachably connected thereto a plurality of members adapted to be secured to said natural hair at spaced apart locations around the periphery of the area to be covered by said hairpiece by crimping of portions of said members onto said natural hair, each said portion defining a channel for receiving said natural hair and being formed of a crimpable material which when crimped by subjecting said portion to compressive forces to close said channel permanently deforms and fastens itself to natural hair in said channel, placing said hairpiece over the area to be covered thereby with said members being located between said hairpiece and said head, placing said natural hair in said channels, and securing said members to said natural hair at spaced apart locations around the periphery of the area to be covered by said hairpiece by crimping said portions onto said natural hair.

23. A method for securing a hairpiece to the head of a person having some natural hair, said method comprising providing a plurality of members adapted to be secured to said natural hair at spaced apart locations around the periphery of the area to be covered by said hairpiece by crimping of portions of said members onto said natural hair, each said portions defining a channel for receiving said natural hair and being formed of a crimpable material which when crimped by subjecting said portion to compressive forces to close said channel permanently deforms and fastens itself to natural hair in said channel, placing said natural hair in said channels, securing said members to said natural hair at spaced apart locations around the periphery of the area to be covered by said hairpiece by crimping said portions onto said natural hair, and then detachably connecting said hairpiece to said members.

* * * * *